United States Patent [19]

Schwarze

[11] 4,038,853

[45] Aug. 2, 1977

[54] TUBE BENDING MACHINE

[76] Inventor: Rigobert Schwarze, Olpener Str. 46-474, Cologne 91, Germany, 5000

[21] Appl. No.: 718,775

[22] Filed: Aug. 30, 1976

[30] Foreign Application Priority Data

June 11, 1976 Germany ..... 2626202

[51] Int. Cl.[2] ..... B21D 7/04

[52] U.S. Cl. ..... 72/157; 72/159

[58] Field of Search ..... 72/149, 153, 154, 155, 72/156, 157, 158, 159, 217, 219

[56] References Cited

U.S. PATENT DOCUMENTS

| | | | |
|---|---|---|---|
| 983,664 | 2/1911 | Wilson | 72/157 |
| 3,147,792 | 9/1964 | Hautau | 72/157 |
| 3,276,235 | 10/1966 | Stanley | 72/149 |

FOREIGN PATENT DOCUMENTS

| | | | |
|---|---|---|---|
| 25,279 | 1/1956 | Germany | 72/149 |
| 883,827 | 5/1954 | Germany | 72/155 |
| 896,442 | 6/1954 | Germany | 72/157 |
| 1,917,926 | 10/1969 | Germany | 72/157 |
| 2,101,162 | 7/1972 | Germany | 72/149 |

*Primary Examiner*—E. M. Combs
*Attorney, Agent, or Firm*—P. D. Golrick

[57] ABSTRACT

A tube bending machine including a frame with a bed at one end pivotally supporting a horizontally swingable bending table bearing tube bending and clamping mechanism, including a jaw for clamping tube stock against a tube bend forming and clamping die secured coaxially at the table pivotal connection; a tube feed carriage with a rotatable tube-clamping collet for a tube to be fed to, clamped and bent at the die, the tube carriage being guided on the bed to shift to and from the said die, and free to advance during a bending operation by powered swing of the table; the die periphery having a partially circumferentially extending tube-forming groove concentric to and with groove centerline in a plane perpendicular to the pivot axis; the die and jaw each being turnable relative to the table selectably to present to each other cooperating straight grooves or cooperating curved grooves for clamping straight or curved length portions of tube to be bent, including also clamping grooves curving out of the plane of the forming groove; the said grooves being complementary in cross section to the semi-circumference of tube; the clamping grooves of the die leading tangentially into the tube-forming groove; with manual and powered shifting of the die and jaw disclosed; whereby, without removing a tube from the machine, successive bends may be produced in a tube with or without an intervening straight portion, and in the same or different planes.

12 Claims, 7 Drawing Figures

FIG.1
(Prior Art)
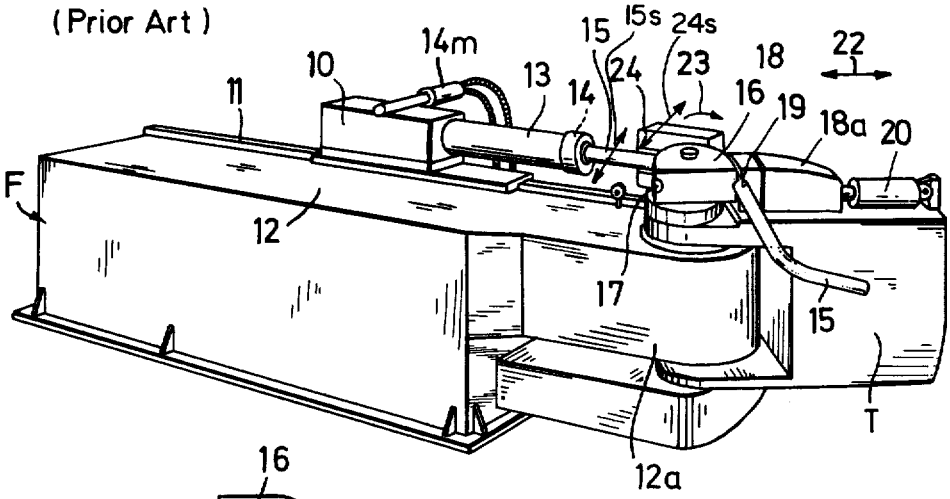
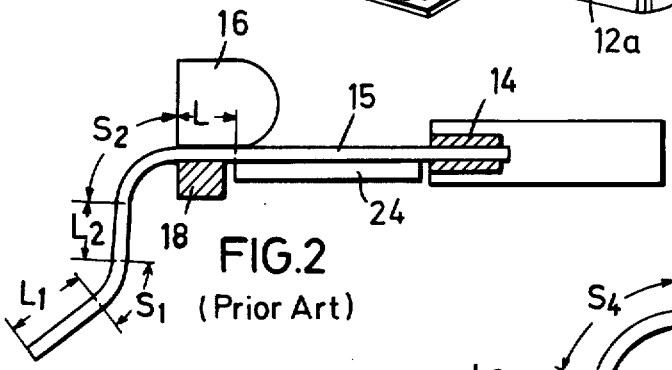
FIG.2
(Prior Art)
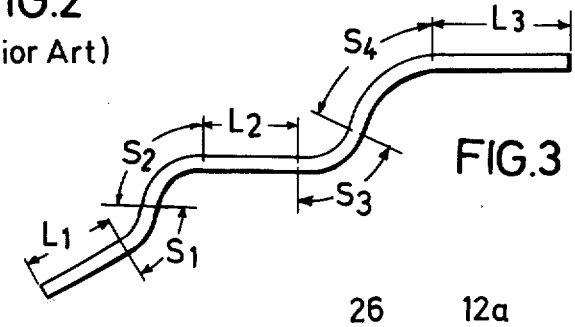
FIG.3
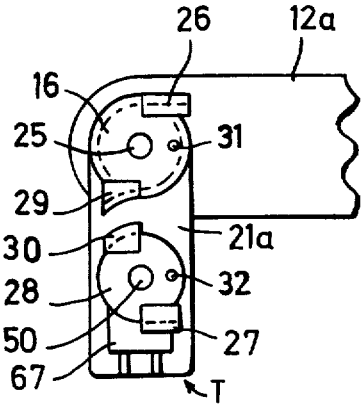
FIG.7

TUBE BENDING MACHINE

The present invention is concerned with a tube bending machine having a frame with bed pivotally supporting a swingable bending table, which table carries a tube bending form or die and a clamping jaw displaceable to and from relative to the bending die; and a rotatable tube-clamping collet supported in a tube-advancing carriage freely displaceable during a bending operation effected by table swing to wrap a tube portion onto the die.

For the fabrication from straight tubular stock of several tubes or pipes each having successive, i.e., adjacent, bends or curves, without straight intermediate portions therebetween, by the apparatus and the method hitherto common, using a bending form or die having a straight tube-clamping groove running into a peripherally extending tube-forming groove and a cooperating clamping jaw having tube-clamping straight groove, the grooves complementary in depth and section contour to the tube external semi-circumference, each tube is formed with one bend or a plurality of spaced bends and then is removed from a machine.

After completion of a run of a desired number of tubes each partially formed in this fashion, the bending form and clamp jaw are disassembled from the machine and replaced by a so-called curved forming die and curved clamping jaw with clamping grooves contoured complementary to previously bent tube portions adjacent to which another bend is required without an intervening straight portion.

After this machine re-tooling, in a second phase of production, the partially bent tubes are again introduced into the machine, and further tube bends are produced as in the work operations first above described.

Since already bent tubes are cumbersome to handle, it is difficult to introduce them into the machine by hand and generally mechanical introduction is, in practical and economic sense, impossible.

The necessary changing of the bending die and clamping tooling, and the two-fold introduction into the machine of each tube thus to be bent, with as well the intermediate storage of tubes, render this prior art manner of operation quite inconvenient and time consuming.

A further disadvantage of such prior art machines and the production methods entailed by their use, is that is is difficult in this second work phase to make desired bends immediately adjacent to the bends produced in the first phase of operations. In practice, often exact placement and/or orientation of the bent tube is impossible upon re-introduction into the machine, so that undesirable overlapping of the boundary region of the first-made bends by the second or subsequently formed bends can occur. Frequently this results in many tube rejects; and in any event it is difficult to maintain desired tolerances.

Moreover, the aforedescribed production method is not suitable for an automatic or numerically controlled tube bending machine, where the bending operations are numerically controlled, for example by a punch card system or a computer which continually monitors or controls the feed carriage stroke and the collet rotation and evaluates these motions. For upon reintroduction into the machine, of a tube thus already bent, practically it is hardly possible to again attain the exact disposition and orientation especially in the collet, which it had in the machine for the first bending operations.

To avoid the aforementioned difficulties, attendant upon trying to bring two successive bends adjacent each other, in practice, the tubes are bent in one work run with one tooling setup in the machine, thus without change of the bending form and clamping jaw, by producing the tubes with a straight intermediate portion between successive bends. But tubes thus formed suffer the disadvantages that they can not have an optimal contour for the intended product, and accordingly are uneconomic; and for some purposes tubes thus produced would not be commercially acceptable.

For example in the case of automotive vehicle exhaust pipes, especially for passenger automobiles, it is desired that the bends of the tube closely fit contours on the vehicle underside, that is, conform closely to the chassis structure, axles and motor region which the pipe passes, since divergencies from conformity lead to a high tube material consumption and also to undesired exhaust pipe swing or vibration during vehicle operation. Hence often successive bends desirably would be, and at times must be, present in an exhaust pipe without intervening straight portions.

In such exhaust tubes, for passenger vehicles especially, the closest tolerances are desired inasmuch as mass-produced products are in question, both for exhaust pipes as such and the vehicles; and an adjustment or correction of or for an out-of-tolerance tube or pipe at the time of mounting to a vehicle being assembled on an assembly line conveyor belt is not permissible, since the time required would disrupt the line tempo and operation. Hence for manufacture of products such as exhaust pipes, the described prior art machines and or methods labor under considerable disadvantages.

The general object of the present invention is to bend tubes requiring successive bends without intervening straight lengths with a single setup of machine tooling; and also a single setup of each workpiece, that is, with a single introduction into the collet of each tube.

Another object is to provide a tube bending machine for the described purpose.

A further object is to provide in a tube bending machine of the type described forming die and tube clamping structure, enabling the bending of tubes in such fashion that the machine may operate completely automatically and with numerical control and accordingly with greater precision for merging bends.

For the attainment of one or more of these objects, in a tube bending machine of the type above described, the bending forming die and the clamping jaw are each provided with both a straight clamping groove and one or more curved clamping grooves corresponding in cross section to the semi-circumference of the tube to be formed, as selectably useable tube clamping surfaces; both the bending die as well as the clamping jaw being supported rotatably relative to the bending table to bring into cooperative opposed dispositions selected grooves of shapes appropriate to bent and straight shapes of the tube portions to be clamped during operations leading to production of a finished bent tubular workpiece.

By providing on the bend forming die, in addition to the above described tube shaping groove, and the straight and curved clamping grooves in the plane of the shaping groove, a further groove which curves out of the plane of the bending form groove, and also in the clamping jaw a further cooperative corresponding groove, which additional grooves serve as further clamping surfaces, successive bends easily may be adjacently made in the tube in different planes.

The bend forming die is turnable coaxially and relative to the bending table pivot or swing axis; and the clamping jaw, on the other hand, may be swingable about an axis which is either parallel or "perpendicularly skew" relative to the table swing axis, hence also relative to the axis of the bending die. The designation of two lines or axes as "perpendicularly skew" here means not only that the axes as geometrical lines are non-parallel and non-intersecting, but also that each is perpendicular to a respective plane including the other.

To bring selectively cooperative clamping parts of the bend forming die and of the clamping jaw into opposed working positions, rotation, relative to the bending table on which they are disposed, can be achieved in various fashions, mechanically by motor drive or manually; and the movable parts of the bending form or die and of the clamping jaw structure are held in the selected work position through appropriate means such as latch devices or stops.

Through this provision of plural selectable clamping formations on die and jaw, setup and removal of diverse bending form dies and clamping jaws is not necessary for the production of tubes having successive bends without intervening straight lengths; and accordingly the tubes to be bent need not be introduced into the tube bending machine a second time to produce those immediately successive bends. Also close tolerances may be held.

With this improved machine and enabled mode of tube production, a tube in process is continually engaged in a collet on the tube feed carriage, and changes in the point of collet tube-gripping or orientation may be effected while the tube is held fixed elsewhere in the machine. Therefore the bending operations can be controlled automatically, by means of a punch card system or by a computer control, since the position of the feed carriage and of the clamping collet rotatable on the latter can be continually sensed or observed, and the value or signal obtained for a position variable can be compared, as an "is-value", with an "ought-value" stored or present in the bending control program, so that thereby automatic correction of positioning can be precisely obtained as each bend is about to be produced. The controls as such are not part of the invention here dealt with.

By a further feature of the invention, the straight and the curved grooves, affording the tube-clamping surfaces, are provided in respective insert block elements, which are removably secured in larger body components of the bend forming die structure and of the clamping jaw structure, so to minimize the extent to which tooling structure must be specifically designed and made for clamping different bends or curvatures to be conferred on the tube stock of a given diameter, and even in the case of the jaw structure, for tubing of different diameters.

Other objects and advantages of the invention will appear from the following detailed description and drawings wherein:

FIG. 1 is an overall perspective view of a prior art tube bending machine of the type with which the present invention is concerned;

FIG. 2 is a schematic drawing of a tube clamped in the forming die and clamping jaw, and also showing various bends with intervening straight portions, as produced by prior art tube bending machines and operations;

Figure 4:
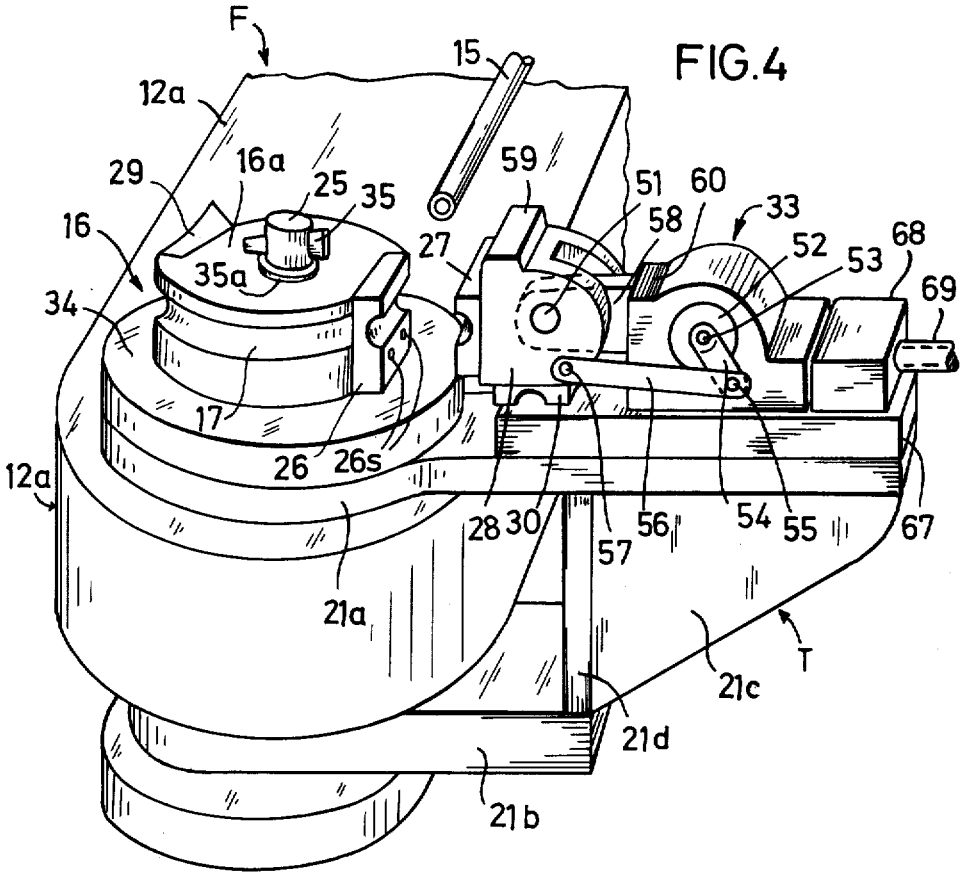
Figure 6:
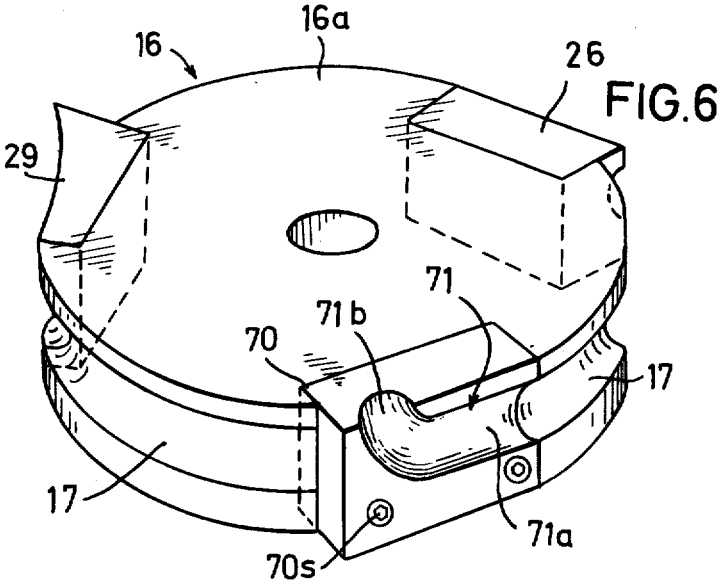
Figure 5:
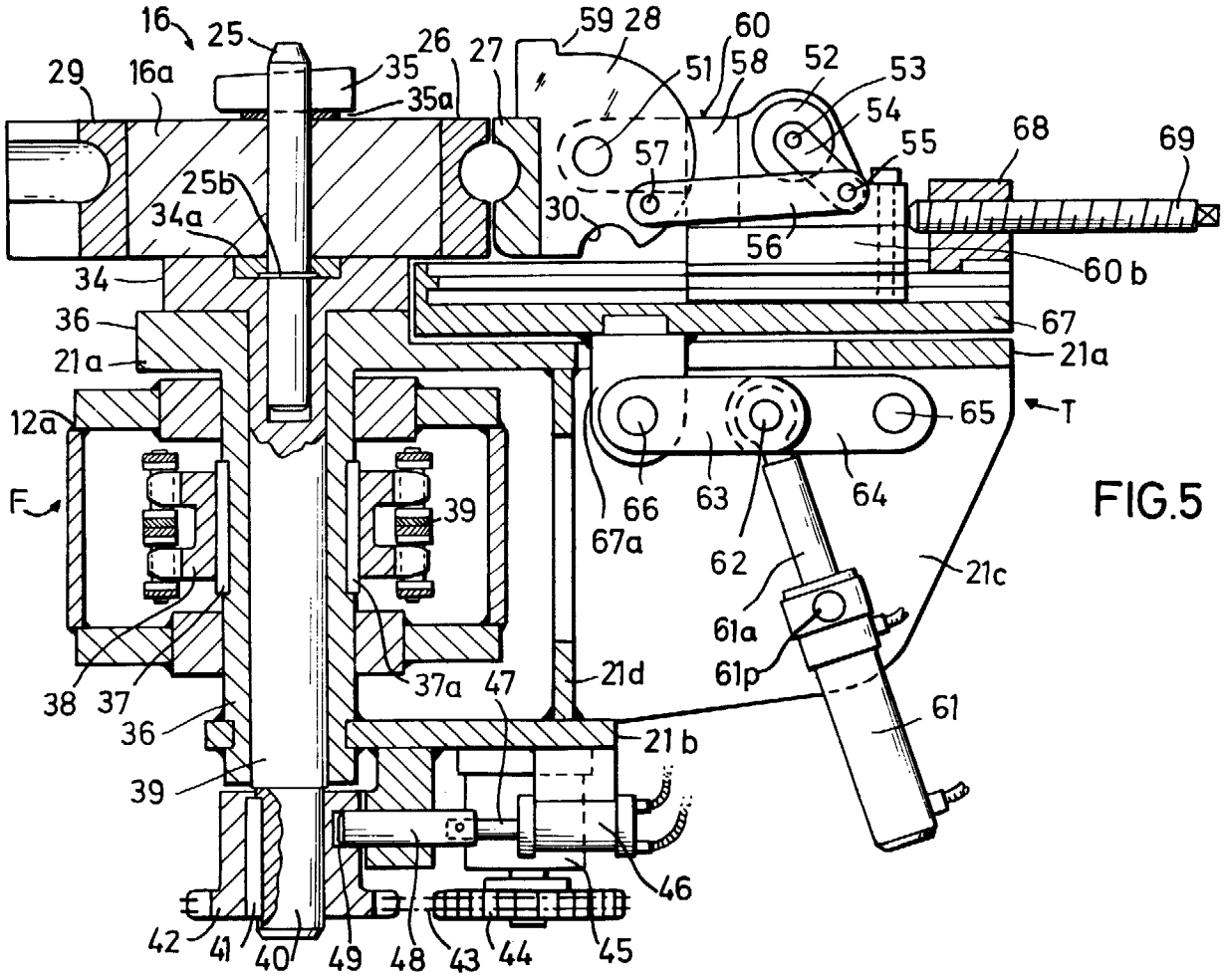

FIG. 3, presented for comparison with FIG. 2, shows some bends achievable with a machine in accordance with the present invention, especially two successive bends without an intervening straight tube portion;

FIG. 4 is an enlarged fragmentary view in perspective of the swing table end of a bending machine showing parts particularly embodying the present invention, but otherise for omitted parts being generally similar to the prior art machine of FIG. 1;

FIG. 5 is a vertical sectional view through the bending table and its pivot or swing axis, the section being taken at the table center generally longitudinally, but showing also a certain minor variation, mainly in the bend forming die and the clamping jaw structure, as compared with FIG. 4;

FIG. 6 is an enlarged perspective view of a rotatable shiftable forming die structure with changeable inserts carrying clamping grooves of particular shapes;

FIG. 7 is a generalized fragmentary top plan view at the bending table end of the machine showing modification of the die assembly and clamping jaw mechanism.

OVERALL FORM OF THE BENDING MACHINE TYPE — PRIOR ART

FIG. 1 shows the general structure and overall arrangement of the type of tube bending machine to which the present invention relates, but with the prior art expedients for clamping and forming the workpiece tube to be bent.

The machine is comprised of a base frame F and a bending table T horizontally swingably mounted, in a hinge-like or clevis-like structure, on a reduced projecting frame right end 12*a* toward which a tube feed or advance carriage 10 is slideably mounted and guided by longitudinal rails or gibs 11 supported along one side of the horizontal bed top surface 12 of the frame. The tube carriage bears a tubular workpiece-accepting hollow cylinder 13 including a rotatable tube-gripping collet 14 opened and closed by known conventional means for firmly gripping a workpiece tube 15, with the tube axis horizontal and parallel to the rails.

A motor, e.g., hydraulic motor 14*m*, in conventional manner, through a worm on the motor output shaft and a gear connected to the collet 14 is capable of driving the latter through 360° rotation, so that the workpiece tube can be not only clamped and moved longitudinally of the machine relative to the bed but also the workpiece may be rotated by a desired amount about its axis at the collet-gripped tube portion. The geometrical and coincident rotational axis of the collet and hence the axis of a straight tube therein gripped, extends horizontal and parallel to the rails 11.

Known conventional power means are usually provided to drive the table in a bending swing from, and to return it to, a start position perpendicular to the bed; and also to shift the feed carriage longitudinally of bed 12; and these conventional means are not shown.

Typically, as specific bending tooling, a bend forming die 16 is mounted in an assembly coaxially of the vertical pivot axis of table swing at the projecting right frame end portion 12*a*, being in effect secured on and rotating with the table T in its swinging movements. The table bears a cooperating clamping jaw mechanism including a tube-clamping jaw 18, longitudinally slideably supported on the swing table T for advance to and retraction from the die 16 by a jaw carriage 18*a*, which is shifted to and fro, by a double-acting linear motor, such as a hydraulic or pneumatic cylinder 20, as indicated by the double-headed direction arrow 22.

The forming die 16 (see also FIG. 2), U-shaped in plan, has a peripheral groove 17, semi-circular in cross section to correspond in shape to the outside semi-circumference, or semi-cylindrical shape of the tube to be worked; the centerline of the groove lying in a horizontal plane perpendicular to the table swing axis, which plane for convenience of reference is termed the plane of the bend forming die 16. The axis of collet 14 lies in this plane, and hence also the axis of a straight tube clamping groove 19 of the jaw 18.

A similarly horizontally-straight-grooved bending reaction support block or shoe 24 is mounted on the bed 12 in the region adjacent the bend form, to support the tube slideably but against deflection during bending, forcing the tube to wrap into forming groove of die 16, when the latter rotates with the tube-bending table swing (in direction of arrow 23) with the tube clamped between die 16 and jaw 18. The shoe 24 provides free sliding support to a tube.

With the usual U-shaped exterior shape of the tube-forming die 16, seen in plane schematic FIG. 2, the groove 17 comprises an arcuate, semi-circular, reach or groove portion about which a tube bend is made, in extent depending upon swing of the table; and tangential extensions of the curved portion, on each opposite parallel side, each is straight groove side portion which can cooperate with the straight groove 19 of the clamping jaw 18, as tube clamping surfaces.

Generally the arcuate portion of the groove 17 is concentric with the axis of the rotation of the form die 16, hence the table swing axis. Further the collet axis is located to coincide with the straight parts or tangent to the curved parts of centerlines of the groove in shoe 24 and of grooves 17 and 19 when the latter are in operative start position.

The bending tooling, namely, forming die 16, clamping jaw 18 and shoe 24, are changeable to provide grooves of different diameters as required for accommodating workpieces of different diameters.

FIG. 2 shows an example of the product of, the procedure for obtaining the product by, and limitations of, the machine of the prior art.

On die 16, (see FIG. 2) a straight groove side has a length L and the adjacent end of shoe 24 is located at the end of this straight length, i.e., at the point where the curved forming portion begins. This length L, in effect the clamped length of the tube, usually represents at least the minimum tube length which must be engaged to sustain the clamping forces required for the bending operation.

This minimum will vary with different tube materials and cross sections, i.e., diameters and wall thickness, which affect section rigidity; and also with different radii of curvature to be bent, which is one factor determining the bending forces to be applied, and thus also the various reaction forces to be sustained.

In a typical operation, with the table T at start position, 16 and jaw 18 are positioned as shown in FIG. 2, but with jaw 18 retracted so that the straight grooves are aligned with the axis of the collet 14, into which or through which, by hand or automatically, a tube 15 is fed forward to desired position, to be then firmly gripped by collet closing actuation and to be clamped by actuation of cylinder 20 to advance the clamping jaw carriage 18*a*, hence jaw 18.

Table T is swung clockwise, as indicated by an arrow 23 in effect wrapping the tube about the curved tube-forming portion of die groove 17, to the extent of the desired bend, not exceeding 180°, with due allowance for known spring back considerations; the carriage 10 being free to advance as required.

Where the feed carriage and collet structure is such that a long tube, e.g., longer than bed length, may be through-fed, next, with the tube remaining yet clamped between die 16 and jaw 18, the collet is opened and the carriage 10 is backed off, so that in effect the tube is fed or axially advanced through the collet, e.g., by an amount equalling the straight tube length spacing to the location of the next bend; and the collet is reclosed to maintain tube rotational orientation. But when the minimum tube length required for collet-gripping is reached, or there is no through-feed or feed out of the collet, the feed is effected simply by carriage advance of the collet-gripped tube as next noted.

Next the jaw 18 is withdrawn sufficiently to enable the tube to feed past the die by advance of the carriage 10, then allowing the forming die and table to be swung back to starting position. The collet is driven to rotate the tube by the angle required if the next bend is to be in another plane than the first, or by 180° if it is to curve oppositely from the first but in the same plane. The jaw 18 again is actuated to clamp on a straight tube portion; and the second bend is then produced by an ensuing table swing through the needed angle.

There is required after each bend in any event at least a sufficient tube feed to present a straight portion of the fed tube for subsequent clamping by die 16 and jaw 18.

Since, with the prior art machine tooling, the clamping occurs between two opposed straight groove portions respectively on die 16 and jaw 18, necessarily the part before each bend of the resulting bent tube product must be straight.

Hence in FIG. 2, for example, to produce the first bend for curved section $S_1$, the initial straight tube end length $L_1$ must be at least as great as the length L, of the effective tube clamping length of the tooling. When the desired final product tube is to have a straight end portion as shown for $L_2$ longer than the length L, no problem arises; but when shorter, cropping to required size obviously represents waste.

More importantly, however, whether two successive bends are to be in different planes, or in the same direction in one plane, or in different directions, as in FIG. 2, this machine and tooling required that, between the first bend $S_1$ and the second $S_2$ the intervening straight portion $L_2$ as a minimum be at least as long as L, an inherent consequence of the very tooling form of the machine. In FIG. 2, the clamping elements have clearly engaged the tube as close as possible to the end of the 90° bend $S_2$. Where the latter farther to the right, it would in part fall within the straight clamping elements, to be distorted from shape under clamping forces. Consequently the reverse bend about to be produced in FIG. 2 will be spaced from $S_2$ again by the length L.

Thus the prior art apparatus machine and tooling have imposed limitations upon the final form which can be given to the product tube in consequence of these inherently arising straight portions intervening between two bends; and as well, for certain products, have entailed some waste of material, because the product may be larger than needed, were it otherwise more closely shaped to conformity with an environment of product use, or because of cropping to size at the end portions; all a result of the minimum clamping length required.

FIG. 3 — EXEMPLARY PRODUCT BY THE PRESENT INVENTION

FIG. 3 presents an example of a notably different tube producible on a machine of the invention by successive bending operations with one tool setup and a single introduction of the workpiece into the machine.

Merging bends, i.e., successive bends coming one immediately after the other, as at $S_1$ and $S_2$ and at $S_3$ and $S_4$, may be formed as hereinafter described, all quite as readily as the two successive spaced bends $S_2$ and $S_3$ which by design are to have an intervening straight portion $L_2$.

MACHINE OF INVENTION — FIGS. 4, 5, 6

FIGS. 4, 5, and 6 show pertinent portions of a machine and its bending tooling, whereby in accordance with the present invention there may be obtained a bent or formed tube product of the character shown in FIG. 3. A modification will be described relative to FIG. 7.

The general overall arrangement of this improved bending machine is similar to that described for FIG. 1, except as hereinafter noted. Hence, fragmentary FIG. 4 shows only that machine end which pivotally supports the bending table T (shown at "start" position) and the associated bending tooling, i.e., the tube forming and clamping tooling, and related structures more particularly involved in the invention. Parts analogous to those of FIG. 1 are in general designated by similar reference numrals or letters; but for clearer showing of the more significant parts of the invention, the support shoe is omitted, through disposed with the same location and relation to the die as the shoe 24 in FIGS. 1 and 2.

FIG. 5, though generally an enlarged longitudinal vertical center section through the bending table T, shows also slight variations from FIG. 4 in certain structures.

Again as in FIG. 1, bending table T is pivoted at the reduced bed end 12*a*, preferably as shown in FIG. 5 and hereinafter described in detail, by a clevis-like disposition of the parallel projecting top and bottom plates 21*a*, 21*b* integrally joined in a weldment structure including vertical side plates 21*a* and transverse vertical 21*d* to constitute a rigid table T.

In a forming die mechanism supported at shaft 25, the die assembly 16 comprises a thick heavy centrally apertured disk-like body 16*c*, whereon the circumferentially extending forming groove 17 is interrupted by rectangular seats for clamping-groove-formation-bearing insert block elements 26 and 29, straight and curved respectively, removably secured in the periphery at diametrically opposite locations by bolts as at 26*s* for element 26. The plan form of this die arrangement, also used in the machine modification of FIG. 7, may be seen in the latter figure; and so also in plan the shape of the cooperating groove bearing jaw blocks 29 and 30, through in FIG. 7 these are supported on a differing carrier 28. The three-block die of FIG. 6 may be used when useful.

The straight clamping groove and the concavely-curved clamping groove in respective elements 26 and 29 lie in the plane of, and at respective counterclockwise ends run tangentially into, the forming groove 17 provided directly in the periphery of disk 16*a*, thus in a bending operation to lead a tube 15, clamped therein and reaction-shoe-supported, into the forming groove.

The said plane, as the previously defined "die plane", is the plane of the curved centerline of groove 17 coaxial to shaft 25 and the pivot axis of table T. In this plane the centerline of grooves 26 and 29 and of a respective positioned jaw groove, and also the axis of the collet are coplaner.

A clamping jaw mechanism, designated as a whole by numeral 33, includes a primary jaw carriage 67 longitudinally advanceable on the table with further support structure for a pivotal jaw carrier 28, which thus is shiftable on the table to and fro relative to the tube bend forming die for tube clamping action; the die and the jaw carrier being also shiftable to bring selected cooperative clamping grooves into operative disposition; all as hereinafter described.

In similar fashion on jaw carrier 28, preferably (as in FIG. 4) the straight and curved clamping groove formations are provided by changeable grooved insert blocks 27 amd 30 bolted into respective seats on the carrier, and selectively brought into operative position in opposed relation to the die 16 by carrier turning, about a horizontal axis 51, which is perpendicularly skew to the axis of the die and of the table. However, one or both of the jaw grooves may be formed directly in the carrier 28 as at 30 in FIG. 5. Though on a different type carrier, FIG. 7 shows the plan form of the two jaw formations 27 and 30 used here.

In table T (see FIG. 5) a vertical hollow pivot shaft portion 36, journalled in and extending through hollow bed end 12*a*, provides firstly the table swivel mounting to the machine frame; and secondly, a vertical throughbore for rotatably receiving a die assembly support shaft 39 integrally top-flanged at 34 as an under-support for die 16. Within the hollow bed extension 12a, by keys 37—37*a* a double sprocket or gear 38 is fixed on shaft 36 for table swing drive through a doubled sprocket chain 39 by known conventional drive means, e.g., from a hydraulic motor or the like housed within the main frame F, but not shown since per se no part of the invention.

For some conditions it may be useful that the location of the collet axis can be horizontally shiftably adjusted among parallel positions, that is, in a direction transversely of the machine bed; for example by shifting the rails; or the cylinder-collet assembly 13–14 may be shiftable relative to a feed carriage base part engaging the rails. This would enable change in the spacing of the prolonged axis of assembly 13–14 relative to the vertical axis of table swing, therefore to the center of curvature of a tube forming groove on the die, not only to accommodate dies of different sizes but also, on a single die, periperal die portions of different radii; a shoe 24 being similarly shiftable.

TUBE FORMING DIE MECHANISM

The die assembly 16 is removably mounted, but non-rotatably relative to table T, on the shaft top flange 34 by structure including a wedging key 35 driven above washer 35*a* and through an appropriate slot of the stud shaft 25; the latter in turn being received coaxially in a deep socket or blind bore of shaft 39, and there held by plate 34*a*, secured flush in a flange recess by screws or the like, as a keeper to engage a stud shaft shoulder or retainer ring 25*b*. In addition to or alternatively to the die-immobilizing frictional engagement usually thus obtained, if desired for some situations, positive mechanical engagements may be provided to hold 16*a* non-rotatably relative to shaft 39.

To bring a desired clamping surface formation of the die into working opposition to the jaw carrier 28, on the projecting reduced lower die shaft end 40, a gear or sprocket 42 is retained by a key 41, and is power-driven by a chain 43 reeved over an output sprocket 44 of an appropriate motor 45 supported on the table bottom plate 21*b*, such as a bi-directioned hydraulic motor. A reciprocating latch motor 46, for example, a double-acting hydraulic or pneumatic piston-cylinder unit, or a suitable solenoid, has a moved rod 47 pivotally connected to a reciprocating latch bolt 48 slideably supported on the table bottom plate, to engage in a respective one of appropriately located spaced radial apertures carried on shaft 39, such as recess 49 in the hub on the sprocket 42. Each of such apertures corresponds in position to a proper orientation of the aforedescribed grooves in the die assembly 16.

Thus after latch release, die assembly 16 may be turned relative to table T by appropriate controlled energization of motor 45 to bring a selected groove into position opposite the clamping jaw, to be there held by re-engagement at latch 48, and thus held to rotate with table T.

CLAMPING JAW MECHANISM

The clamping jaw mechanism 33 includes the jaw carrier 28 with rounded slotted back received and secured, by horizontal pivot shaft 51, on the forwardly projecting integral arm extension 58 of the jaw carriage body 60 bolted to the secondary slide or base member 60*b* engaged in a longitudinal slideway on the primary jaw carriage 67, the latter being longitudinally slideably guided on table top plate 21*a*.

To present a desired clamping jaw formation toward the die, the jaw carrier 28 is driven by an appropriate two-way rotational motor 52, housed in the carriage body 60, for example a hydraulic motor, with output shaft 53 carrying a keyed crank arm 54, at crank pivot pin 55 connected through a pivotal link or connecting rod 56, to a pivot pin 57, eccentric on the jaw carrier 28. The projecting shoulder 59 and, for example, the pivot pin 57 may serve as jaw positioning stops for clockwise and counterclockwise movements by respectively engaging the top and bottom surfaces of arm 58.

To reciprocate the entire jaw carriage mechanism 33, a suitable reciprocating motor 61, such as a double-acting hydraulic cylinder unit, is pivotally supported by trunnions or pivots 61*p* between the parallel vertical table side plates 21*c*; and the piston rod 61*a* is connected at the center pivot 62 of toggle members 64–63, with outer ends pivoted respectively at 65 between table side plates 21*c* and at 66 to the primary slide base 67 through a heavy lug member 67*a*, depending through a longitudinal slot of table top plate 21*a*, and if desired serving also as a guide by slot engagement.

For finer adjustment of tube clamping pressure, an adjustable abutment screw 69 is threaded through a buttress block 68 affixed at the outboard end of bore 67 to engage the back end of the jaw carriage body 60.

Thus by rod retracting or extending actuation of the cylinder unit 61 through appropriate application of fluid pressure to respective ends, the entire clamping jaw carriage assembly 33 on the primary carriage slide 67 is reciprocated on the table to move the jaw away from and toward the tube forming and clamping die 16 for clamping release of or clamping engagement on a tube by a clamping jaw formation presented by operation of the jaw selection motor means, and with force multiplication through the toggle linkage.

With the jaw carriage 67 retracted, then by rotation of the motor 52 clockwise (in FIGS. 4 or 5) the groove at 30 will be rotated into opposition to 16; and at the same time, the die assembly 16 being driven by motor 45 to bring the cooperating groove formation of 29 into position. Herein at times the grooves as such will be referred to by the respective groove bearing insert reference number.

Specific energizing and control circuitry, hydraulic and/or electrical, for a tube feed carriage motor, a table swing drive motor, a collet actuating motor, the collet rotating motor 14*m*, the die shifting or selection motor 45, the die latch motor 46, the jaw groove selection motor 52, and the clamping jaw activating motor 61, are not shown, since these may be conventional for the desired sequencing or actuation and per se are not part of the present invention. However, it is evident that with these several motor means the machine is adapted for automatic operation including numerical control of diverse types and a flexible operation, by appropriate programming.

FORMING DIE OF FIG. 6

FIG. 6 shows, in enlarged perspective, a forming die assembly for use in FIGS. 4 and 5, and a further clamping groove shape. Here the disk 16*a* of die assembly 16 has three equally spaced rectangular peripheral recesses as seats for the insert block member 26 with the straight clamping groove, for the concavely-faced member 29 with the concavely curved clamping groove, and for a flat-faced groove third insert block 70 held by machine screws or bolts 70*s*; again all appropriately secured in the seats with the grooves thereof each at one end aligned with a respective part of the arcuate bending groove 17 as previously described relative to FIGS. 4 and 5.

However, in block 70 the clamping groove 71 is curved in a vertical plane, having the portion 71*a* at the end aligned with the groove 17 (i.e., with its centerline running tangentially into the centerline of 17), merging into the upwardly curved portion 71*b* by which the groove swings up out of the die plane previously defined.

In similar fashion, three corresponding cooperating grooves are then included on the pivoted jaw carrier 28; with provision of stop or locating means for establishing a third angular position of the carrier.

This member 70 merely exemplifies another clamping formation which may be used to clamp an already bent tube portion of corresponding shape with the plane of that bent portion intersecting the die plane for a further bending a succeeding merging bend in a plane other than that of the first bend. The shape and radius of the overall form of this more complex groove 71 is of course selected in accordance with the tube bend which is to be accommodated.

MODIFICATION OF FIG. 7

The simplified fragmentary outline plan view of FIG. 7 presents another specific modification of a machine embodying this invention, which is particularly suited for easy selective positioning of the die assembly 16 and of the clamping jaw carrier assembly 28 by manual manipulation rather than, as in the previous figures, by powered driving means, though powered drives could be used. Parts corresponding to those of previous figures again are indicated by similar or analogous reference numerals or characters.

The die and jaw inserts 29–30, shown in operative disposition and open, have curved clamping formations (respectively concave and convex) appropriate for making a reverse bend merging into, and in the same plane as, a preceding bend to be clamped therein. Here again, a reaction support shoe, such as shoe 24 in FIG. 1, is omitted for clarity of representation of other structure.

The bending forming die assembly 16 is basically identical with that described for FIGS. 4 and 5 or 6; but its mounting may be simplified by having stud shaft 25 fixed coaxially in or at the table pivot; with the assembly 16 being manually selectively rotatable on that shaft; but during bending operations being immobilized relative to the table by latch means 31, e.g., a simple heavy shiftable pin in an eccentric hole through the disk-like body of die 16, projecting into engagement with one of appropriately positioned die-locating recesses in the underlying table structure. The latch may be a spring-biased detent pin manually liftable to release 16 for rotation, and then snapping into engagement upon reaching a corresponding recess for the desired position.

Also the three-insert die form of FIG. 6 may be here used with, of course, a corresponding three-jaw arrangement on the carrier 28.

The clamping jaw structure, which may be supported and reciprocated on the table T by a slideable base 67 as previously described for FIGS. 4–5, includes a turnable jaw base or carrier 28, here of disk-like form similar to die 16 of this modification. Carrier 28 is rotatable about a vertical jaw support pivot or rotation shaft 50, firmly affixed in and supported by carriage base 67 to extend parallel to the die supporting stud shaft 25 thus parallel also to the common axis of the die 16 and of the pivot for table T. The jaw carrier assembly 28 has a latch bolt means 32 similar to that of die assembly 16, to engage in recesses in the underlying slide or jaw carriage structure.

When the disks in 16 and 28 are in retracted jaw relation with their latches 31–32 disengaged, simple manual rotation can be effected; after which both are held in selected position by re-engagement of the latches.

OPERATION

Returning then to FIG. 3, it is apparent that for producing the bent tube there represented, initially a straight tube held in the feed carriage collet is first clamped at its end portion $L_1$ between the straight grooved-clamp elements 26–27 of the die and jaw, the table being in its start position (FIG. 4) at right angles to bed 12. The table then is swung through an appropriate angle, with allowance for spring-back, corresponding to the angular extent $S_1$ of the first bend. The jaw 28 is withdrawn from the forming die, releasing the tube bent portion.

The table 21 is then returned to its start position; the tube is rotated by collet 14 through 180°, and the forming die 16 is rotated counterclockwise (seen from above) relative to the table by 180° to bring the concavely curved surface of 29 to and against the convex part of bend $S_1$ and at the same time the jaw carrier 28 is rotated by 90° (in clockwise sense as seen in FIG. 4) to bring the convexly curved groove part 30 into opposition to the concave side of the tube bend $S_1$; and the jaw mechanism is actuated to clamping condition. Thereupon the table T is again swung through the angle necessary to obtain the bend of angular extent $S_2$ following immediately upon $S_1$.

After the clamping jaw is again retracted to release the bent tube, the bending table is returned to start position; the die 16 and jaw carrier 28 are turned to bring the straight grooves elements 26–27 back into opposed working position; the tube 15 is advanced by tube feed carriage 10 to feed the straight length corresponding to $I_2$ past the die, and the tube is rotated 180° by collet 14. These various movements are timed and carried out so that any necessary clearances of the tube relative to the parts are afforded.

The jaw carrier 28 is closed upon the positioned tube, and by the table swing by the required amount, the bend $S_3$ is produced. Bend $S_4$ is produced by a subsequent series of operations similar to those described as following after finishing bend $S_1$ for production of bend $S_2$.

Since the tube remains securely gripped in the collet, through a simultaneously achieved positioning of the carriage and of the collet, an exact positioning of the tube in the bending machine is obtainable for further bend forming. Hence, a merging of the subsequent bend following immediately upon a preceding bend, may be made with great precision.

Of course, tubes also may be formed with straight length portions between successive bends as short as the straight groove formations, in which case, no rotation of the bending form and of the clamping jaw relative to the bending table is necessary to bring curved gripping formations into operation.

When a curve-clamping die formation as 71 on block 70 of FIG. 6 is used instead of 29, or where the whole FIG. 6 type die is used, and a corresponding jaw groove, after the bending of a given region of the tube in one plane, the bend can be followed immediately on the tube length, but in another plane, by another, or merging bend, again without an intervening straight portion, simply by rotating the tube in the collet 14 over a requisite amount of less than 180°, and bringing into position die groove 71 and the corresponding jaw groove, clamping, and then further bending in order to obtain a three-dimensionally bent tube.

I claim:

1. A tube bending machine comprising:

a bending table supporting frame providing a bed, a swingable bending table pivotally supported by the frame, a bending forming die supported by the table having a tube-forming arcuately extending peripheral groove with its curved groove centerline disposed in a die plane perpendicular to the table pivotal axis, a clamping jaw displaceable on the table to and fro relative to the said die for cooperative jaw-die clamping of a tube adjacent a tube portion to be bent; with a tube-supporting feed carriage shiftable on the bed, said carriage bearing a rotatable tube-gripping collet, and being freely shiftable toward the die along the direction of the axis of a collet-gripped tube portion during a table-swing-effected bending operation on a tube adjacent a portion cooperatively clamped and engaged by said die and jaw, the improvement comprising:

the said bending forming die and the said clamping jaw on their peripheries each having as tube clamping formations a respective straight clamping groove and respectively at least one curved clamping groove spaced from the straight groove, all the said grooves ccorresponding in cross-sectional shape to the external semi-circumference of a tube to be bent, on the die the straight groove and at least a portion of the curved clamping groove having groove centerlines disposed substantially in said die plane, the said bending forming die and the said clamping jaw being each mounted rotatably on and relative to the bending table, whereby selectively the said straight grooves and the said curved clamping grooves may be swung into opposed tube-clamping working disposition.

2. A tube bending machine with improvement as described in claim 1, wherein:

the said tube-forming groove on the die is coaxially disposed about the table pivot axis and, with interruptions at locations of the tube clamping formations, extends substantially around the entire die periphery; and a respective one end of each clamping groove merges tangentially into a contiguous portion of the forming groove.

3. A tube bending machine with improvement as described in claim 1, wherein:

the said die and the said jaw include first curved cooperating tube-clamping formations with clamping grooves having centerlines entirely in said die plane, and second curved cooperating tube-clamping formations which have grooves with respective portions curved outwardly from the described die plane, when the last said formations are positioned in opposed operative relation, whereby two successive bends in different planes may be produced without an intervening straight table portion.

4. A tube bending machine with improvement as described in claim 1, wherein:

the said die is turnable about an axis coaxial to the table swing axis, and the said clamping jaw is turnable about an axis extending parallel to the table swing axis, for bringing selected cooperative grooves thereof into operative opposed working disposition.

5. A tube bending machine with improvement as described in claim 1, wherein:

the said die is turnable about an axis coaxial to the table swing axis, and the said clamping jaw is swingable about a pivot axis disposed perpendicularly skew to the table swing axis, for bringing selected cooperative grooves thereof into operative opposed working disposition.

6. A tube bending machine with improvement as described in claim 1, wherein:

the said straight and the said curved grooves of at least one, of the die and the clamping jaw, are provided in respective insert elements changeably affixed in a body portion of the said one of the die and the clamping jaw.

7. A tube bending machine with improvement as described in claim 1, including respective latching means for holding the said die and the said clamping jaw fixed relative to the bending table after rotation into selected working dispositions.

8. A tube bending machine with improvement as described in claim 1, wherein:

said bending table is swingably supported on said frame, by a hollow pivot shaft;

the said die is supported at one end of a die shaft rotatable in the said hollow pivot shaft; and said die shaft is rotatably driven by motor means for changing the working disposition of the clamping grooves of the die.

9. A tube bending machine with improvement as described in claim 8, wherein:

the said die shaft, on a projecting end remote from the die, carries a gear; and said gear is chain-driven from an output gear of a hydraulic motor as said motor means.

10. A tube bending machine with improvement as described in claim 8, wherein:

the said die is anchorable in selected position relative to the bending table by a latch bolt shiftable by motor means out of engagement with one of a plurality of latch-accepting formations carried on the die shaft.

11. A tube bending machine with improvement as described in claim 1, wherein:

the said clamping jaw is rotationally driven between selectable working dispositions by motor means.

12. A tube bending machine with improvement as described in claim 11, wherein:

said clamping jaw is swingable about a pivot axis disposed perpendicularly skew to the bending table swing axis, for bringing selected cooperative grooves thereof each into operative opposed working disposition to a corresponding groove of the die;

said clamping jaw being pivotally supported on a jaw carriage power-reciprocated on the table toward and away from the said die, for tube clamping and release from between the jaw and the die;

the last said motor means comprising a shaft extending parallel to the clamping jaw pivot axis;

said motor shaft carrying a crank lever arm, connected by a pivotal crank connecting rod to the clamping jaw at a point eccentrically spaced from the pivot axis of the jaw.

* * * * *